US005085278A

United States Patent [19]

Keltner

[11] Patent Number: 5,085,278

[45] Date of Patent: Feb. 4, 1992

[54] FOAM PROPORTIONING INDUCTOR APPARATUS

[75] Inventor: Loren L. Keltner, Kansas City, Mo.

[73] Assignee: T. D. F. Partnership, Kansas City, Kans.

[21] Appl. No.: 597,074

[22] Filed: Oct. 15, 1990

[51] Int. Cl.[5] ..... A62C 35/00; A62C 35/02

[52] U.S. Cl. ..... 169/15; 169/14; 239/317

[58] Field of Search ..... 169/14, 15, 44, 85; 222/399, 400.7, 630; 239/317, 365

[56] References Cited

U.S. PATENT DOCUMENTS

| | | | |
|---|---|---|---|
| 607,562 | 7/1898 | Almstead | 169/15 X |
| 730,723 | 6/1903 | Verschuren | 169/15 X |
| 2,432,146 | 12/1947 | Farris et al. | 169/44 X |
| 2,811,211 | 10/1957 | Eriksson | 169/44 X |
| 4,318,443 | 3/1982 | Cummins | 169/15 |

*Primary Examiner*—Margaret A. Focarino
*Assistant Examiner*—James M. Kannofsky
*Attorney, Agent, or Firm*—Wm. Bruce Day

[57] ABSTRACT

A foam proportioning inductor apparatus is mounted atop a supply tank for providing a quantity of fire extinguishing foam concentrate. The nozzle has a through passage for the flow of water, as in an automatic fire extinguishing system, and has a supply line branch extending into the supply tank for pressurizing the tank with water and driving out a foam concentrate through a concentrate outflow line extending from the supply tank and into the inductor nozzle downstream of a constriction. The combination of the water charge in the tank and the venturi effect created by the nozzle constriction draws the foam concentrate into the water flow stream. The concentrate outflow line has a removable and replaceable pipe section containing a selected size of orifice, permitting the pipe section to be readily changed to select different sizes of orifices to correctly proportion the foam concentrate outflow relative to the different types of foam used in contempory automatic fire fighting systems. Additionally, the water supply line and foam concentrate outflow line include shut off valves which eliminate expensive bypass piping and permit the concentrate supply tank to be replenished during fire fighting operations while water passes through the inductor nozzle.

3 Claims, 3 Drawing Sheets

FOAM PROPORTIONING INDUCTOR APPARATUS

FIELD OF THE INVENTION

This invention relates to foam proportioning inductor nozzles and in particular, to an inductor nozzle arrangement which includes bypass piping and removable and replaceable orifices.

BACKGROUND OF THE INVENTION

Foam proportioning inductor nozzles and tank systems are used in the so-called deluge system of fire fighting installations which provide a sprinkler or spray arrangement with overhead sprinkler heads which are arranged to deluge or send down a spray of water or foam automatically upon sensing a fire condition. Such deluge systems are commonly used in aircraft hangers, large industrial buildings for soybean processing plants, chemical production facilities and in other areas where highly flammable fumes may be present. The deluge system is foam based and uses a variety of protein or AFFF (aqueous film foaming foam) based foams. Each such foam is subject to differing rates of supply, meaning that the proportion of the foam concentrate to water varies for each particular type of foam used.

It has been known to use inductor nozzles mounted atop foam concentrate supply tanks which are in turn mounted upon a ground floor of the hanger, industrial shop or the like and connected into the fire suppression piping system. Normally, an expensive piping bypass is run around the tank and nozzle combination, which isolates the inductor nozzle from the waterflow stream when the tank is being replenished with foam, as during a protracted fire. Also, the normal course of operation has been to remove and replace the inductor nozzle with another such inductor nozzle with a different size orifice for correct proportioning whenever a different type of foam concentrate is selected for use. The inductor nozzle is quite expensive and is a major factor in the high cost of a change-over to another type of foam, inducing some foam users not to switch to more preferable varieties of foam until required to do so by local ordinances, even though the justification to switch may become well known prior to enactment of new ordinances.

Accordingly, the present invention involves a foam proportioning inductor apparatus including a foam concentrate supply tank and an inductor apparatus mounted atop the tank. Situated between the inductor nozzle and the tank are water supply lines leading into the tank for pressurizing the tank and providing the driver for the foam concentrate and a foam concentrate outflow line from the tank back into the nozzle which carries the foam. In the foam concentrate outflow line is a pipe section providing a removable and replaceable orifice. Because the pipe section with the orifice is relatively inexpensive, it can be readily changed in lieu of changing to a more expensive inductor nozzle, thereby permitting the user greater flexibility in selecting the proper foam to be used as a fire suppressant when the industrial use is altered or new and more effective foams are developed. Further, the arrangement includes shut off valves in the supply line and the fluid concentrate outflow line which eliminate the need for an expensive and extensive bypass circuit to route water around the inductor nozzle during replenishment while the system is being used to suppress fires. The disclosed arrangement includes valves so that the fire fighter does not have to reroute the water flow around the inductor nozzle and tank while replenishing the tank with foam, leading to easier use and increased responsiveness.

OBJECTS OF THE INVENTION

The principal objects of the present invention are: to provide a foam proportioning inductor apparatus in which orifice sizes can be easily removed and replaced, to provide such an inductor apparatus having valves so that the apparatus does not have to be bypassed by expensive piping circuitry while being replenished; to provide such an apparatus having an internal series of baffles so that foaming of the foam concentrate during replenishment is substantially alleviated; to provide such an apparatus which is compact and economical to manufacture; and to provide such an apparatus which is sturdy and efficient in use, and particularly well adapted for the intended purpose.

Other objects and advantages of this invention will become apparent from the following description taken in connection with the accompanying drawings wherein are set forth, by way of illustration and example, certain embodiments of this invention.

DETAILED DESCRIPTION OF THE INVENTION

Figure 1:
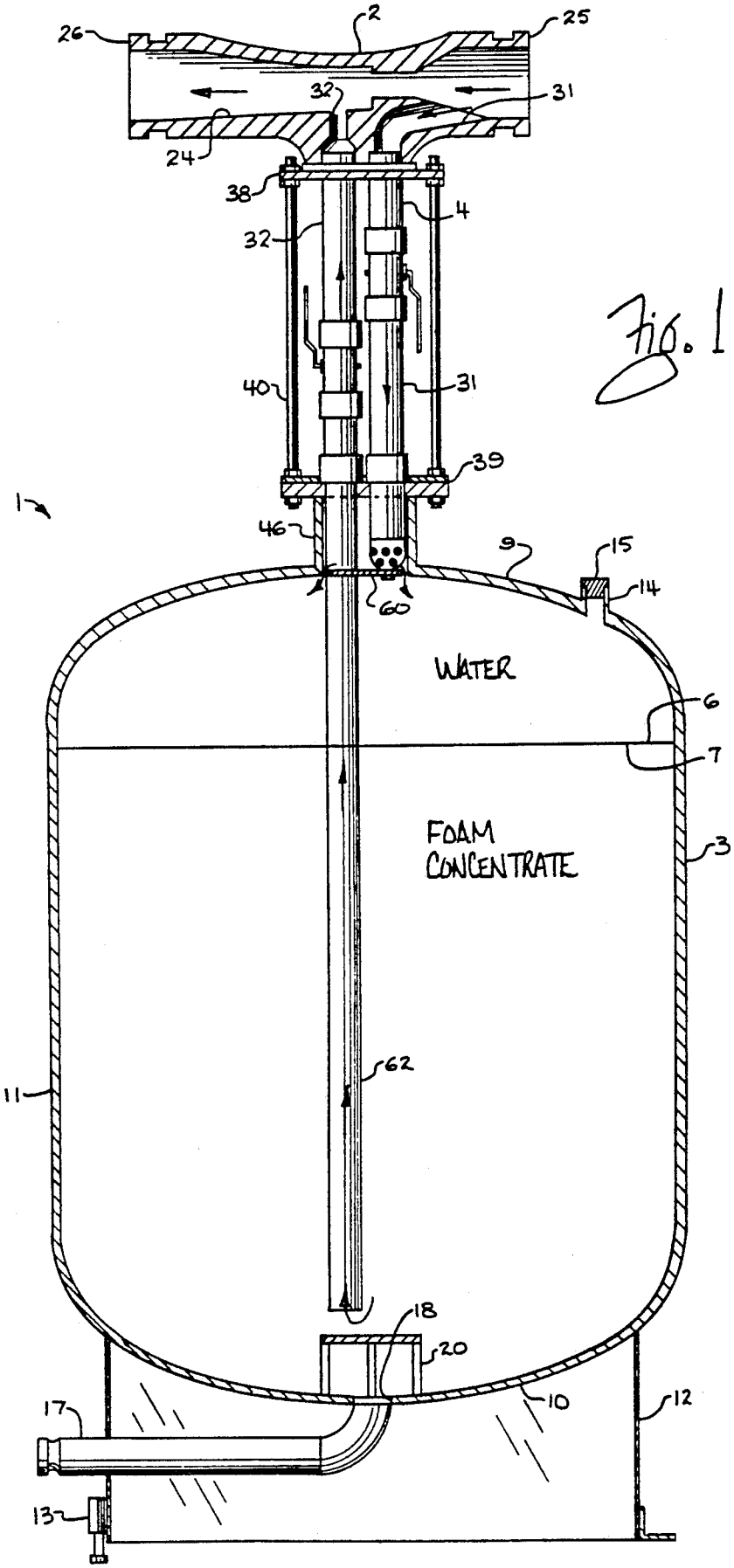
FIG. 1 is a longitudinal sectional view of a foam concentrate tank and nozzle arrangement embodying the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for the claims and as a representative basis for teaching one skilled in the art to variously employ the present invention in virtually any appropriately detailed structure.

Referring to the drawings in more detail:

A foam proportioning inductor apparatus, generally indicated by the reference numeral 1, FIG. 1, includes an inductor nozzle 2 mounted atop a foam concentrate supply tank 3. Situated between the inductor nozzle 2 and the tank 3 is a piping arrangement 4 including various parts set forth below.

Figure 4:
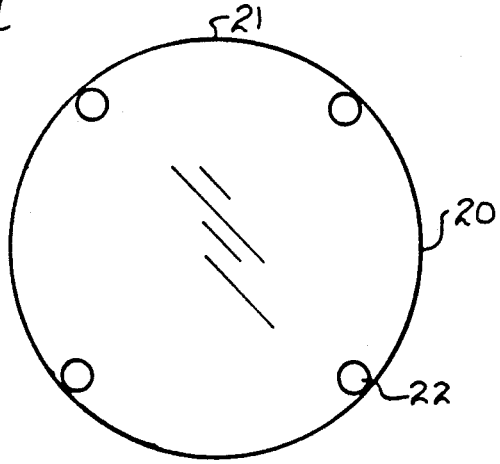
FIG. 4 is an enlarged, plan view of an inlet baffle within the tank.
Figure 5:
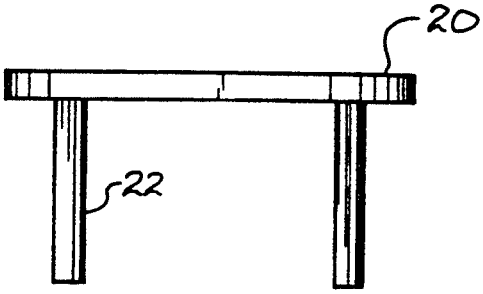
FIG. 5 is an elevational view of the inlet baffle.

The tank 3 may be of substantially any configuration to provide an appropriate enclosure or reservoir and when in a deluge type fire fighting sprinkler system, is of a size normally containing between 300 and 800 gallons of fire suppressant foam concentrate. The foam concentrate may be selected from various types of protein or AFFF foams, all of which are preferably delivered to the inductor nozzle 2 at different rates for maximum efficiency. The foam concentrate 6 is normally heavier than water and the tank 3 utilizes a water charge 7 which tends to float on top of the foam concentrate as a propellant driver that is at the same pressure as the fire suppressant piping system pressure. In the illustrated example, the tank 3 is of a double ended oblong cylindrical configuration and has an upper end 9, a lower end 10 and a circular side wall 11. The tank 3 is supported at its lower end 10 by a stand 12 which may include leveling brackets 13 and other appropriate mounting means. A vent 14 is secured by a cap 15. A drain and fill pipe 17 extends from the lower end 10. Positioned over an interior port 18 of the drain and fill pipe 17 is a baffle 20, FIGS. 1, 4 and 5, which consists of a disc 21 and four legs 22. The baffle 20 is positioned over the port 18 so that when the foam concentrate 6 is pumped into the tank 3 through the drain and fill pipe 17, the flow is diffused by the baffle 20 and excessive foaming reduced.

The inductor nozzle 2, mounted atop the piping arrangement 4 is, in turn mounted atop the tank 3. The nozzle 2 is substantially an elongate tube having an interior through passage 24 with opposite ends 25 and 26. In the illustrated example, the ends 25 and 26 have grooves 27 for use with grooved couplings, such as those made by the Victaulic Corporation for quick connections. The ends 25 and 26 connect to further piping (not shown) forming part of the fire suppression piping system. The through passage 24 includes an interior constriction 29 which forms a venturi effect at the termination of the constriction 29. Two passages branch from the interior of the through passage 24, the first such passage being a supply line 31 communicating with the inlet end 25 whereby incoming water is directed through the supply line 31, through a right angle bend and down into the piping arrangement 4 as hereinafter explained. The second passage extending from the through passage 24 is a fluid concentrate outflow line 32. The concentrate outflow line 32 includes a neck portion 33 and a threaded fitting portion 34. Similarly, the supply line 31 includes a threaded fitting portion 35. The neck portion 33 of the concentrate outflow line 32 is of sufficient size to provide substantially no or little restriction to flow of the foam concentrate.

Figure 2:
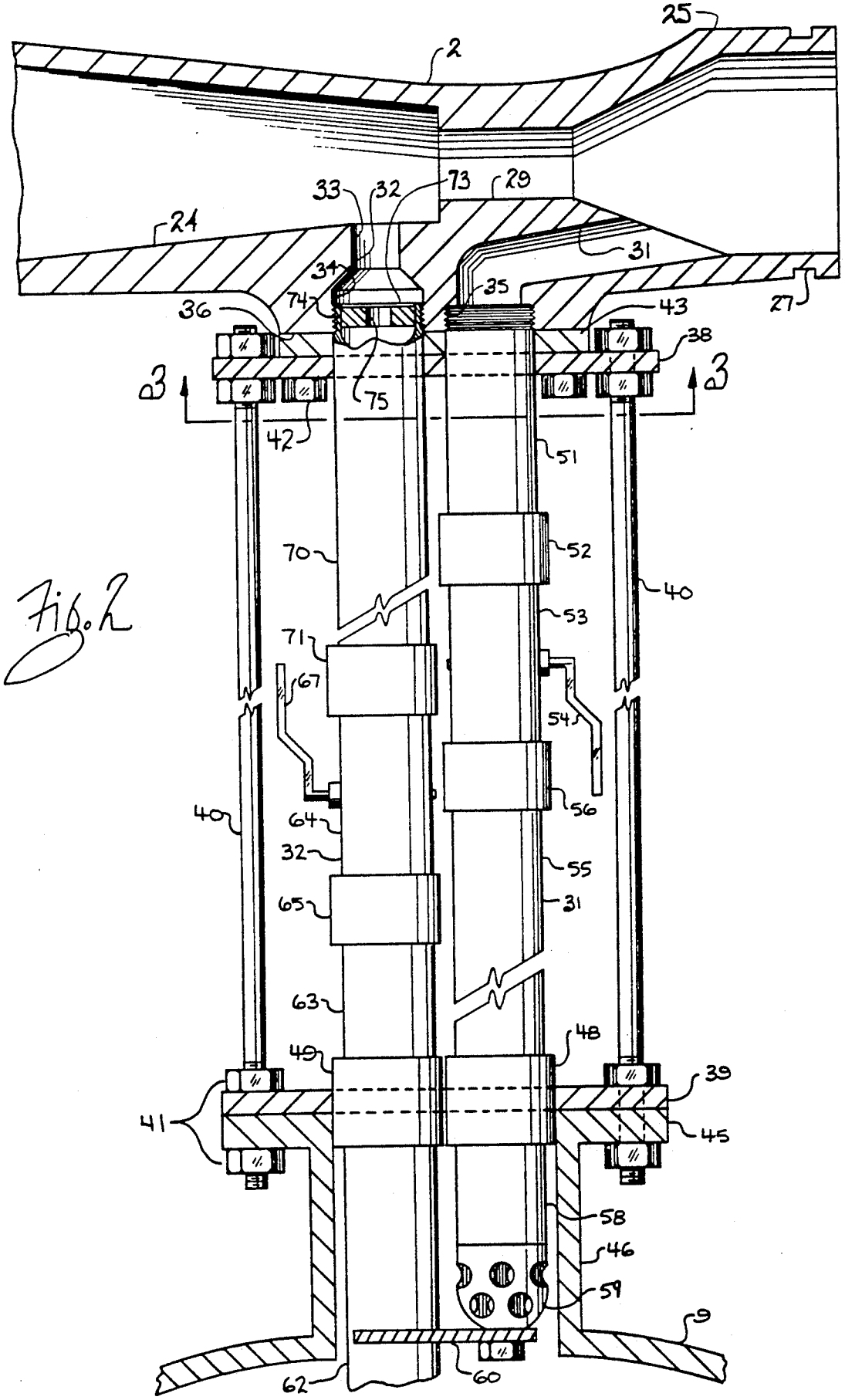
FIG. 2 is an enlarged, longitudinal sectional view of the inductor nozzle situated atop a foam supply tank.
Figure 3:
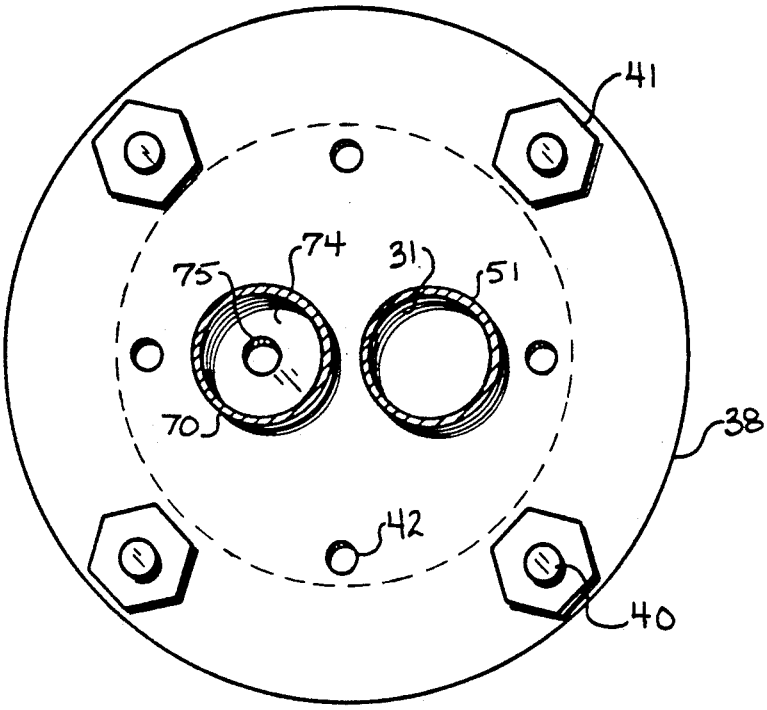
FIG. 3 is a transverse, sectional view taken along line 3—3, FIG. 2.

The inductor nozzle 2 is mounted atop the piping arrangement 4 and has a flat mounting base 36 to which the piping arrangement 4 is mounted. The piping arrangement 4 includes an upper plate 38, FIGS. 1, 2 and 3, and a lower plate 39. An array of four rods 40 extend between the circular upper and lower plates 38 and 39 and are suitably affixed thereto by nuts 41. In turn, the upper plate 38 is connected to the nozzle mounting base 36 by bolts 42. In the illustrated example, a spacer plate 43 is situated between the mounting base 36 and the upper plate 38 for height adjustment.

The lower plate 39 is mounted upon a flange 45 extending from a neck 46 of the tank 3. Because the tank 3 must be sealed to maintain pressure, the lower plate 39 is tightly joined to the flange 45 and may include suitable sealing gaskets and the like (not shown).

The supply line 31 and the concentrate outflow line 32 extend through the piping arrangement 4. Sealed couplings 48 and 49 extend through the lower plate 39 and are appropriately sealed to prevent pressure loss around the coupling. Referring first to the water supply line 31, the water supply line 31 is composed of several segments; first, a short piping segment 51 is threaded into the fitting portion 35 and joined by a coupling 52 to a valve body 53 including a handle 54 for manual shut off of fluid flow. The valve body 53 is in turn connected to a lower piping segment 55 by a coupling 56. The lower piping segment 55 is connected at its lower end to the sealed coupling 48. Another piping segment 58 extends downwardly from the lower plate 39 and protrudes into the tank neck 46, terminating in a flow diffuser tip 59 having a plurality of holes for discharge of the water. The circular diffuser plate 60 is mounted to the diffuser tip 59 and is of a smaller diameter than the interior diameter of the neck 46.

In the illustrated example, there is a ¼ inch difference between the two and, accordingly, water from the diffuser tip 59 is spread out over the diffuser plate 60 to spray into the tank 3 in a narrow ring pattern. The purpose of the diffusion of the incoming water is to prevent the water stream from pouring directly into the foam concentrate within the tank 3 and causing mixing of the two.

Normally, the tank 3 is substantially filled with a selected foam concentrate and is charged with a water head by inflow through the water supply line 31. The water preferably stays on top of the foam concentrate and is pressurized so as to force the foam concentrate downwardly. It is not desirable to mix the water with the foam concentrate within the tank because to do so would improperly dilute the foam concentrate mixture to be delivered to the inductor nozzle 2. The gentle ring spray pattern produced by the flow diffuser tip 59 and the diffuser plate 60 fulfill this requirement.

Referring to FIG. 1 the concentrate outflow line 32 includes a lower elongate pipe 62 which extends substantially the height of the tank 3 and terminates shortly above the baffle 20. At its upper end 9, the elongate pipe 62 is connected to the sealed coupling 49 in the neck 46. Above from the coupling 49, a short piping segment 63 is connected to a valve body 64 via a coupling 65. The valve body 64 includes a manual handle 67. An orifice pipe segment 70 is situated atop the valve body 64 and connected by a coupling 71, FIGS. 1 and 2, for removal and replacement. The orifice pipe segment 70 includes at its upper end 73 a disc 74 having an orifice 75 there through. In the illustrated example, the orifice disc 74 is suitably formed from flat plate stock and drilled, and mounted in the orifice pipe segment 70 by welding, although other means of securement such as a threaded joint may be used as desired. The upper end 73 of the orifice pipe segment 70 is removably screwed into the pipe fitting portion 34 so that the orifice disc 74 is in close proximity to the neck portion 33. The closeness of spacing is desired so that appropriate pressure flow rates are maintained between the pressure drop point after the constriction 29 and the orifice 75. In actual use, the range of orifice sizes are calculated to be between 0.75 to 1.25 inches, depending upon the type of foam used. In the illustrated example, removal and replacement of the orifice is done by selection of different orifice pipe segments 70.

In use, the apparatus 1 is employed as part of a fire suppression system, such as an automatic deluge systems dispensing protein foam or an AFFF foam (aqueous film forming foam). Starting with an empty tank, the tank 3 is filled with water through the bottom drain and fill pipe 17 after removing the vent cap 15. After the tank 3 is filled with water, the inward flow of foam is started through the drain and fill pipe 17 and is diffused by the baffle 20 so that excessive mixing of the concentrate with water does not occur. When the tank is full, the filling with foam is stopped and the drain and fill pipe 17 closed and the vent cap 15 replaced. Water is used as a propellant for the foam and the tank is pressurized by the water supply line valve 53. In a typical installation, the water pressure is supplied to the tank through the inductor nozzle 2. Appropriate valves upstream of the inductor nozzle 2 are closed awaiting receipt of an opening impulse, as from an automatic fire detection circuit. Upon operation of the fire suppression system, the upstream valve (not shown) opens and pressurizes the tank so it starts to expel the foam concentrate, both because of the water pressure hydrostatic head within the tank and the venturi action of the water flowing past the nozzle constriction 29. The foam concentrate is forced up through the elongate pipe 62 and through the orifice pipe segment 70 where it is properly proportioned according to the particular foam type for mixing and dilution with the water flowing through the nozzle 2.

For those situations where the fire is extensive and refilling of the apparatus 1 is required while the system is in use, the handles 54 and 67 are closed to close off the tank 3 to additional water and the fill and drain pipe 17 opened, the vent cap 15 opened and water drained from the tank 3. Thereafter, it is filled with foam concentrate as previously explained and foam flow started again by opening of the valve bodies 53 and 64.

It is to be understood that while certain forms of the present invention have been illustrated and described herein, it is not to be limited to the specific form or arrangement of parts described and shown.

What is claimed and desired to be secured by Letters Patent is as follows:

1. A foam proportioning inductor apparatus comprising:

a) a supply reservoir tank for providing a quantity of fluid concentrate;

b) inductor nozzle means positioned atop said tank as a unit and movable therewith, said nozzle means having a through passage for flow of water and an interior constriction inducting a pressure drop in the flow of water through said nozzle means, said nozzle means having inflow and outflow ends for joining to inflow and outflow lines;

c) mounting means including a spacer defining a connector area supporting said inductor nozzle means atop said tank;

d) supply line means separate from said mounting means and branching from said nozzle means prior to said constriction and extending downwardly through said connector area and into said tank for providing a change of water therein;

e) fluid concentrate outflow line means separate from said mounting means extending from said supply reservoir and upwardly through said connector area and into said inductor nozzle means and joining said through passage after said constriction for drawing fluid concentrate into the flow of water;

f) orifice means in said fluid concentrate outflow line means for proportioning the flow of fluid concentrate from said tank into the flow of water through aid inductor nozzle means; and g) said outflow line means including means for removal and replacement for selection of an outflow line means having an orifice means of selected size.

2. The foam proportioning inductor apparatus set forth in claim 1 wherein said supply line means and said outflow line means include valves positioned between said nozzle means and said tank and in said connector area.

3. A foam proportioning inductor apparatus comprising:

a) a supply reservoir providing a quantity of fluid concentrate;

b) inductor nozzle means having a through passage for flow of water and having an interior constriction inducting a pressure drop in the flow of water through said nozzle means;

c) supply line means branching from said inductor nozzle means prior to said constriction and communicating with said supply reservoir for providing a charge of water therein;

d) fluid concentrate outflow line means extending from said supply reservoir and into said inductor nozzle means and joining said through passage after said constriction for drawing said fluid concentrate into the flow of water;

e) orifice means in said fluid concentrate outflow line means for proportioning the flow of fluid concentrate from said supply reservoir into the flow of water through said inductor nozzle means; and f) said supply reservoir having a drain and refill line extending from a bottom of said reservoir and having a terminating interiorly of said reservoir, and including a baffle means located at the interior termination of said drain and refill line for diffusing inward refill flow of said fluid concentrate.

* * * * *